United States Patent [19]

Castaldi

[11] Patent Number: 5,031,638

[45] Date of Patent: Jul. 16, 1991

[54] DIRECT-FORMED MOUTHGUARD, A BLANK FOR USE IN MAKING THE MOUTHGUARD AND A METHOD OF MAKING THE MOUTHGUARD

[75] Inventor: Cosmo R. Castaldi, West Hartford, Conn.

[73] Assignee: Roll-A-Puck Limited, West Hartford, Conn.

[21] Appl. No.: 492,722

[22] Filed: Mar. 13, 1990

[51] Int. Cl.[5] ..... A61C 5/14

[52] U.S. Cl. ..... 128/861; 128/862

[58] Field of Search ..... 128/861, 862, 848, 859, 128/860

[56] References Cited

U.S. PATENT DOCUMENTS

| | | | |
|---|---|---|---|
| 3,073,300 | 1/1963 | Berghash | 128/862 |
| 3,089,487 | 5/1963 | Enicks | 128/861 |
| 3,303,844 | 2/1967 | Johnson | 128/862 |
| 3,379,193 | 4/1968 | Monaghan | 128/862 |
| 3,385,291 | 5/1968 | Martin | 128/862 |
| 3,411,501 | 11/1968 | Greenberg | 128/862 |
| 3,416,527 | 12/1968 | Hoef | 128/862 |
| 3,505,995 | 4/1970 | Greenberg | 128/862 |
| 3,527,219 | 9/1970 | Greenberg | 128/861 |
| 3,864,832 | 2/1975 | Carlson | 128/862 |
| 3,943,924 | 3/1976 | Kallestad | 128/861 |
| 4,063,552 | 12/1977 | Going | 128/861 |
| 4,944,313 | 7/1990 | Katz | 128/861 |

*Primary Examiner*—Robert A. Hafer
*Assistant Examiner*—Michael Brown
*Attorney, Agent, or Firm*—McCormick, Paulding & Huber

[57] ABSTRACT

A direct-formed mouthguard is provided. The mouthguard is formed from a blank which includes an inner layer, a rigid core disposed adjacent to and coextensively with the inner layer and an outer layer disposed adjacent to and coextensively with the core. Impressions of the user's intra-oral structures are made in the inner and outer layers by heating the blank to a predetermined temperature range and subjecting the blank to bite pressure. The impressions are set and the finished mouthguard is formed by cooling the blank below the predetermined temperature range. The core is formed from a material having a softening temperature above the predetermined temperature range and therefore provides structural support for the inner and outer layers when the blank is heated to the predetermined temperature range and after the blank is cooled to form the finished mouthguard.

14 Claims, 1 Drawing Sheet

DIRECT-FORMED MOUTHGUARD, A BLANK FOR USE IN MAKING THE MOUTHGUARD AND A METHOD OF MAKING THE MOUTHGUARD

BACKGROUND OF THE INVENTION

The present invention relates to protective mouthguards commonly used by athletes to prevent injuries. More particularly, the present invention provides a protective mouthguard which can be formed directly by the user, thus eliminating the need for a custom made mouthguard. The present invention further provides a blank useful in making such a direct-formed mouthguard and a method of making the mouthguard.

In the United States, protective mouthguards are required at all amateur levels in several sports, including football, ice hockey, women's field hockey and men's field lacrosse. A properly fitted mouthguard provides significant protection against injuries to the teeth and soft tissues of the oral cavity and significantly reduces forces that may cause neck injuries, concussions and jaw fractures.

A custom made mouthguard formed on a plaster model of a user's maxillary or mandibular detention is preferred by the majority of athletes. However, custom made mouthguards must be constructed and fitted by a dentist, dental technician or professional sports trainer under the supervision of a dentist and the resulting high cost and limited availability of such mouthguards has precluded their widespread use. Instead, most athletes choose to use either a direct-formed thermoplastic mouthguard in which a stock plastic mouthguard is softened in hot water, placed in the users mouth and formed by the application of bite pressure, or a ready-made stock mouthguard used without the need for any fitting, both of which are low in cost and readily available at most retail sports outlets.

Unfortunately, stock mouthguards and prior art direct-formed thermoplastic mouthguards are deficient in several important respects. Both types of mouthguards are generally ill-fitting and uncomfortable. Such mouthguards are often characterized by insufficient tissue coverage which results in a fit so loose that the mouthguard must be held in place by constant bite pressure, resulting in decreased user ventilation, or by attachment to a face guard, an option not available for athletes playing basketball, soccer, baseball and all other sports where face guards are not used or required. In other cases, the tissue coverage provided by stock mouthguards or direct-formed thermoplastic mouthguards is often so excessive that the oro-facial muscle attachments tend to dislodge the mouthguard.

Accordingly, it is an object of the present invention to provide a well fitted, comfortable mounthguard which is formed directly by the user through the application of bite pressure.

It is a further object of the present invention to provide a mouthguard of the direct-formed type which remains firmly in place within the user's mouth without the application of constant bite pressure or attachment to an associated face guard.

It is a still further object of the present invention to provide a method whereby a user quickly and easily make a well fitted and comfortable direct-formed mouthguard.

SUMMARY OF THE INVENTION

The present invention meets the above-stated objects by providing a blank for use in making a direct-formed mouthguard. The blank comprises an inner layer of a moldable, settable, shock-absorbing material which conforms to a user's intra-oral structures when subjected to bite pressure at a predetermined temperature range. A core layer of rigid, force-transmitting material is disposed adjacent to and coextensively with the inner layer. The blank further includes an outer layer disposed adjacent to and coextensively with the core layer. The outer layer is also formed from a moldable, settable, shock-absorbing material which conforms to the user's intra-oral structures when bite pressure is applied at the predetermined temperature range.

The material forming the core layer is characterized by a softening temperature above the temperature range in which the inner layer and outer layers are conformable to the intra-oral structures of the user. Thus, the core layer provides structural support for the inner and outer layers not only at normal intra-oral temperatures, but also when the blank is heated to the predetermined temperature range wherein the inner and outer layers are conformable to the user's intra-oral structures.

Preferably, the blank is generally arcuately shaped to fit over either the upper or lower row of teeth. The arcuately shaped blank has an essentially U-shaped cross-sectional configuration defined by an inner lingual flange, an outer labial-buccal flange and a connecting portion joining the two flanges. The lingual and labial-bucal flanges and the connecting portion are adapted to respectively overlie the lingual, buccal and occlusal surfaces of the user's teeth.

A method for making a mouthguard using the above-described blank is also provided. The user places the blank over the row of teeth of the upper jaw (or the teeth of the lower jaw in the case of a pognathic lower jaw) and determines the overall fit of the blank. If the blank is wider of narrower than the jaw, the anterior portion of the blank is heated to soften the material forming the core layer sufficiently to permit the use to adjust the blank to better approximate the general shape of the row of teeth. The blank is then cooled. Once the blank has been adjusted to the general shape of the row of teeth, the user simply heats the blank to the predetermined temperature range, inserts the heated blank into his or her mouth and presses it occlusally against either the upper or lower jaw, applies bite pressure to conform the inner and outer layers to the intra-oral structures and then removes and cools the blank to form the mouthguard.

A mouthguard comprising the above-described blank is also disclosed.

DETAILED DESCRIPTION OF THE DRAWINGS

DETAILED DESCRIPTION OF THE INVENTION

Figure 1:
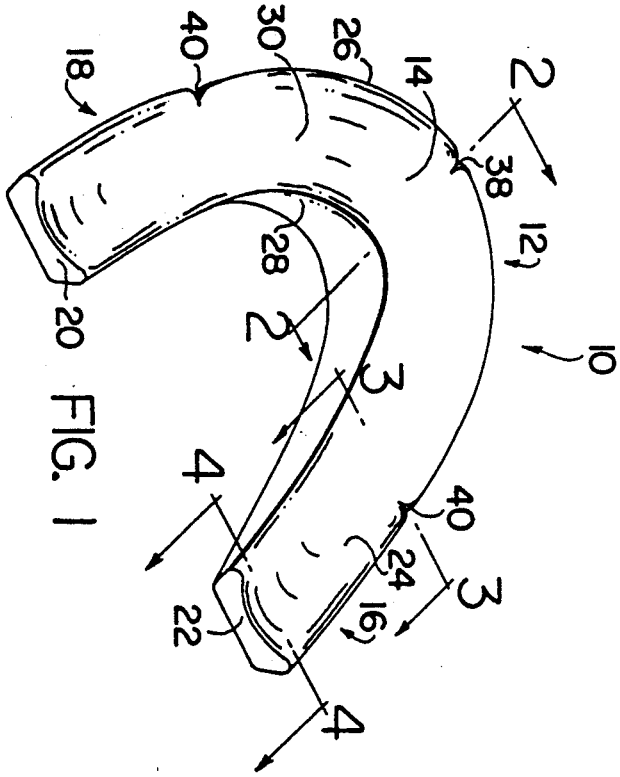
FIG. 1 is a perspective view of a blank useful in making the direct-formed mouthguard of the present invention.

FIG. 1 illustrates a blank useful in making the direct-formed mouthguard taught by the present invention. The blank 10 is generally arcuately shaped to fit over either the upper or lower row of teeth. The blank includes an anterior arch portion 12, which provides a bite surface 14 for the six front teeth, and two posteriorly extending end portions 16 and 18. The end portions 16, 18 define the terminal ends 20, 22 of the blank and provide a bite surface 24 extending from the canines to the terminal ends which are located at least as far back as the anterior surface of the second permanent molar when the blank is placed in the user's mouth.

Figure 2:
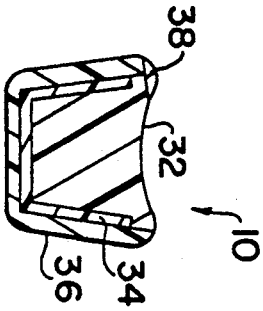
FIG. 2 is a cross-section taken along the line 2—2 of FIG. 1.
Figure 3:
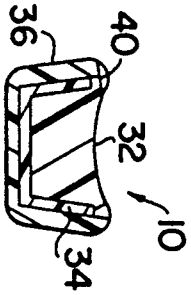
FIG. 3 is a cross-section taken along the line 3—3 of FIG. 1.
Figure 4:
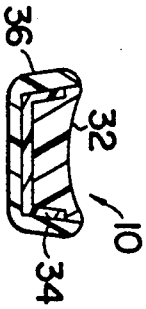
FIG. 4 is a cross-section taken along the line 4—4 of FIG. 1.

Referring now to FIG. 1 and particularly to FIGS. 2–4, the blank 10 has an essentially U-shaped cross-sectional configuration defined by an inner lingual flange 26, an outer labial-buccal flange 28 and a connecting portion 30 joining the lingual and labial-buccal flanges.

When placed in a user's mouth, the lingual and labial-buccal flanges and the connecting portion are adapted to respectively overlie the lingual, buccal and occlusal surfaces of the user's teeth.

Still referring particularly to FIGS. 2–4, the blank 10 is a three-layered composite comprising an inner layer 32, a core 34 disposed adjacent to and coextensively with the inner layer 32 and an outer layer 36 disposed adjacent to and coextensively with the core 34. The inner and outer layers are formed from a resilient, moldable, settable, shock-absorbing material that is conformable to the contours of the user's intra-oral structures at a predetermined temperature range when the blank is subjected to bite pressure. The core is formed from a rigid, force transmitting material which has a softening temperature above the predetermined temperature range at which the inner and outer layers are conformable to the user's intra-oral structures.

The inner and outer layers 32 and 36 may be formed from any resilient, moldable, settable, shock-absorbing material in which impressions of the teeth and other intra-oral structures may be made when the blank 10 is heated to the predetermined temperature range and preserved when the blank is cooled below this range. The material must provide sufficient cushioning against impacts to the mouth and jaws, and it must be non-toxic. Preferably, the inner and outer layers are formed from a thermoplastic material which is colorless, odorless and tasteless.

It is not a required feature of the present invention that the inner and outer layers comprise identical materials. However, in a preferred embodiment of the invention both layers are formed from precisely the same thermoplastic material which is comformable to the contours of the user's intra-oral structures at a temperature range of from about 100° to about 120° F. In the most preferred embodiment of the invention, this thermoplastic material is a copolymer of ethylene and vinyl acetate. An ethylene/vinyl acetate copolymer found to be particularly suitable for forming the inner and outer layers is "ELVAX" 240 available from the E. I. Du Pont de Nemours Co., Wilmington, Del., 19898.

As described above, the core 34 is coextensive with both the inner and outer layers and is formed from a rigid, force-transmitting material having a softening temperature above the predetermined temperature range. Thus, the core provides structural support throughout the arcuate length of the blank for the inner and outer layers during the time when the blank is heated to the predetermined temperature range and the inner and outer layers are moldable, as well as after the blank has been cooled and the moldable material has set to form the finished mouthguard.

The core may be formed from any rigid, force transmitting material which provides the requisite structural support and has a suitable softening temperature; however, in a preferred embodiment of the invention, a thermoplastic material having a softening temperature above about 160° is employed. In the most preferred form of the invention, this thermoplastic material is a copolymer of ethylene and vinyl acetate. An ethylene/-vinylacetate copolymer found to be particularly suitable for forming the rigid core is "ELVAX" 760 available from E. I. Du Pont de Nemours Co., Wilmilngton, Del., 19898.

"ELVAX" 240 and "ELVAX" 760 are both colorless, transparent thermoplastics which may be selectively pigmented during processing. In the most preferred embodiment of the invention, the inner and outer layers of the blank are left transparent and colorless, and the "ELVAX" 760 used to form the core is impregnated with, for example, a yellow or red pigment. Coloring the mouthguard in this manner enables game officials to quickly determine if athletes are abiding by the applicable rules governing the use of mouthguards in a particular sport.

Those skilled in the art of laminating thermoplastic materials will recognize that the blank 10 may be formed according to several well-known methods, including injection molding and co-extrusion. Accordingly, the methods for fabricating the blank as a three-layered composite will not be further described here.

Again referring to FIG. 1 and particularly to FIGS. 2–4, it will be noted that while the lateral dimension of the blank's cross-sectional configuration remains substantially constant throughout the arcuate length of the blank, its height dimension gradually tapers from a maximum at the anterior arch portion 12 to a minimum at the blank 's terminal ends 20, 22. The blank's tapered design accommodates the rotational hinge-like opening and closing action of the mandible which has its center of rotation in the tempero-mandibular joint area. The tapered design also adapts the blank, and the mouthguard formed therefrom, to the physiologic orientation of the jaws in their resting and biting positions. The physiologic adaptation of the blank to the user's intra-oral structures is further enhanced by the indentations 38, 40 formed in the labial-buccal flange and illustrated in FIG. 1, which accommodate the labial frenum and buccal frenum areas respectively.

The blank 10 allows the user to quickly and easily form a well-fitted protective mouthguard directly in the mouth. According to the preferred method for forming the mouthguard, the user places the blank over the row of teeth of the upper jaw to determine the overall fit of the blank. If the jaw is wider or narrower than the blank, the anterior arch portion 12 is immersed in boiling water to heat the arch portion to a temperature sufficient to soften the core material . The user then adjusts the width of the blank to better approximate the general shape of the row of teeth.

The blank is then cooled and re-immersed in boiling water for one to two minutes to heat the blank to the predetermined temperature range. After the blank is removed from the boiling water, it is rinsed for a few second in room-temperture water and then quickly placed in the user's mouth. The user centers the blank over the upper or lower jaw and forces the blank occlusively by exerting gentle finger pressure. The user then bites down firmly on the blank to form impressions of his or her intra-oral structures in the moldable, settable, shock-absorbing thermoplastic material which forms the inner and outer layers. Bite pressure is maintained for two to three minutes while the thermoplastic material sets. The blank is then removed from the mouth and immersed in cold water to fix the impressions and form the mouthguard.

Figure 5:
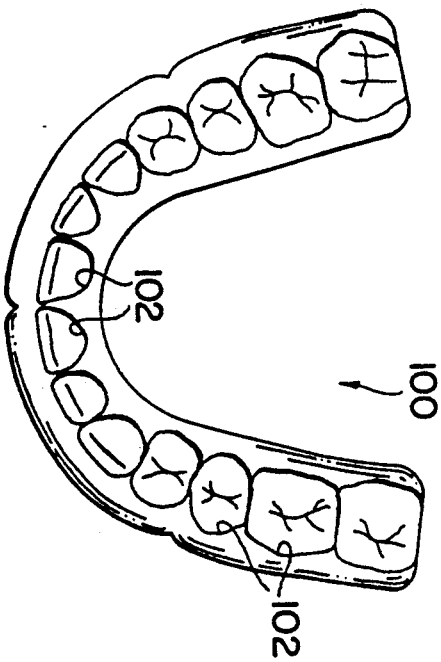
FIG. 5 is a top plan view of a mouthguard formed using the blank of FIG. 1.

A finished mouthguard 100 with the user's teeth impressions 102 formed therein is illustrated in FIG. 5. In most preferred embodiment, the mouthguard 100 is further provided with a strap (not shown) for attaching the mouthguard to the face guard or chin strap of a helmet. This minimizes the risk that the mouthguard will be lost or misplaced.

While preferred embodiments have been shown and described, various modifications may be made thereto without departing from the spirit and scope of the invention. Accordingly, it must be understood that the present invention has been described by way of illustration and not by limitation.

I claim:

1. A blank for use in making a direct-formed mouthguard, said blank comprising:

an inner layer of settable, shock-absorbing thermoplastic material conformable to the contours of a user's intra-oral structures at a predetermined temperature range when said blank is subjected to bite pressure;

a core layer of rigid, force-transmitting thermoplastic material disposed adjacent to and coextensively with said inner layer and having a softening temperature higher than said pre-determined temperature range, said core layer conformable to the general shape of the user's upper or lower row of teeth at said softening temperature to adjust the overall fit of said blank, and an outer layer of settable, shock-absorbing thermoplastic material disposed adjacent to and coextensively with said core layer, said outer layer conformable to the contours of a user's intra-oral structures at said pre-determined temperature range when said blank is subjected to bite pressure.

2. The blank of claim 1 wherein said blank is generally arcuately shaped to fit over a row of teeth, said blank having an anterior arch portion and two posteriorly extending end portions defining terminal ends of the blank, said blank further having an essentially U-shaped cross-sectional configuration defined by an inner lingual flange, an outer labial-buccal flange and a connecting portion joining said flanges, said lingual and labial-buccal flanges and said connecting portion adapted to respectively overlie the lingual, buccal and occlusal surfaces of the user's teeth.

3. The blank of claim 2 wherein the cross-sectional configuration of said blank has substantially constant lateral dimension throughout the arcuate length of said blank and a height dimension which gradually tapers from a maximum at said arch portion to a minimum at said terminal ends.

4. The blank of claim 1 wherein said thermoplastic is a copolymer of ethylene and vinyl acetate and said inner and outer layers comprise the same percentage by weight of vinyl acetate.

5. The blank of claim 4 wherein said inner and outer layers comprise the same ethylene/vinyl acetate copolymer.

6. The blank of claim 1 wherein said pre-determined temperature range is from about 100° F. to about 120° F. and the softening temperature of said rigid, force-transmitting material is above about 160° F.

7. A blank for use in making a direct-formed mouthpiece, said blank comprising:

an inner layer of settable, shock-absorbing thermoplastic material, said inner layer conformable to the contours of a user's intra-oral structures at a temperature range of from about 100° F. to about 120° F. when said blank is subjected to bite pressure;

a core layer of rigid, force-transmitting thermoplastic material disposed adjacent to and coextensively with said inner layer and having a softening temperature above about 160° F., said core layer conformable to the general shape of the user's upper or lower row of teeth at said softening temperature to adjust the overall fit of said blank;

an outer layer of settable, shock-absorbing thermoplastic material disposed adjacent to and coextensively with said core layer, said outer layer conformable to the contours of a user's intra-oral structures at a temperature range of from about 100° F. to about 120° F. when subjected to bite pressure;

wherein said blank is generally arcuately-shaped to fit over a row of teeth, said blank having an anterior arch portion and two posteriorly extending end portions defining terminal ends of said blank, said blank further having a generally U-shaped cross-sectional configuration defined by an inner lingual flange, an outer labial-buccal flange and a connecting portion joining said flanges, said lingual flange, labial-bucal flange and connecting portion adapted to respectively overly the lingual, buccal and occlusal surfaces of a user's teeth, said cross-sectional configuration having a substantially constant lateral dimension throughout the arcuate length of said blank and a height dimension which gradually tapers from a maximum at said arch portion to a minimum at said terminal ends.

8. The blank of claim 7 wherein said settable, shock-absorbing thermoplastic materials and said rigid, force-transmitting thermoplastic material are an ethylene/vinyl acetate copolymer and said first and second thermoplastic materials comprise the same percentage by weight of vinyl acetate.

9. The blank of claim 8 wherein said inner and outer layers comprise the same ethylene/vinyl acetate copolymer.

10. The blank of claim 7 wherein said core and said inner and outer layers are all arcuately shaped.

11. The blank of claim 7 wherein said inner and outer layers are colorless and transparent and said core is pigmented.

12. A method for making a direct-formed mouthguard, said method comprising the steps of:

providing a blank including an inner layer of settable, shock-absorbing material conformable to the contours of a user's intra-oral structures at a predetermined temperature range when said blank is subjected to bite pressure, a core layer of rigid, force-transmitting material disposed adjacent to and coextensively with said inner layer and having a softening temperature above said predetermined temperature range, said core layer conformable to the general shape of the user's upper or lower row of teeth to adjust the overall fit of said blanks, and an outer layer of settable, shock-absorbing material disposed adjacent to and coextensively with said core layer, said outer layer conformable to the contours of a user's intra-oral structures at said predetermined temperature range when said blank is subjected to bite pressure;

heating said blank to said predetermined temperature range and inserting said blank into the user's mouth while said blank remains at a temperature within said predetermined temperature range;

centering said blank over one of the upper or lower rows of teeth of the user and pressing said blank occlusively against said teeth;

applying bite pressure to said blank to form impressions of the user's intra-oral structures in the inner and outer layers and maintaining said pressure while said settable, shock-absorbing materials set, and removing said blank from the user's mouth and allowing said blank to cool to form said mouthguard.

13. The method of claim 12 wherein the step of heating the blank to said predetermined temperature range is preceded by the steps of:

placing said blank over the upper or lower row of teeth to determine the overall fit of the blank;

heating the anterior arch portion of the blank to a temperature sufficient to soften the core material, and adjusting the width of the blank to better approximate the blank to the general shape of the row of teeth.

14. A direct-formed mouthguard comprising:

an inner layer of settable, shock-absorbing thermoplastic material conformable to the contours of a user's intra-oral structures at a predetermined temperature range when said blank is subjected to bite pressure, said inner layer bearing impressions of the user's intra-oral structure;

a core layer of rigid, force-transmitting thermoplastic material disposed adjacent to and coextensively with said inner layer and having a softening temperature higher than said pre-determined temperature range, said core layer conformable to the general shape of the user's upper or lower row of teeth to adjust the overall fit of said blanks, and an outer layer of settable, shock-absorbing thermoplastic material disposed adjacent to and coextensively with said core layer and conformable to the contours of a user's intra-oral structures at said pre-determined temperature range when said blank is subjected to bite pressure, said outer layer bearing impressions of the user's intra-oral structures.

* * * * *